US006206241B1

(12) United States Patent
Terrell et al.

(10) Patent No.: US 6,206,241 B1
(45) Date of Patent: Mar. 27, 2001

(54) AUTOMATED FLUID DISPENSER

(76) Inventors: Brian C. Terrell, 1265 S. Remington Cir., Chandler, AZ (US) 85249; John J. Spilotro, 2500 N. Desert Links Dr., Tucson, AZ (US) 85715

( * ) Notice: Subject to any disclaimer, the term of this patent is extended or adjusted under 35 U.S.C. 154(b) by 0 days.

(21) Appl. No.: 09/513,903

(22) Filed: Feb. 25, 2000

(51) Int. Cl.[7] ..... G01F 11/06

(52) U.S. Cl. ..... 222/63; 222/309; 222/334; 222/129.2; 222/372

(58) Field of Search ..... 222/61, 63, 309, 222/334, 129.2, 372

(56) References Cited

U.S. PATENT DOCUMENTS

| | | | | |
|---|---|---|---|---|
| 3,830,405 | * | 8/1974 | Jaeger | 222/334 X |
| 3,940,019 | * | 2/1976 | Kross et al. | 222/129.2 X |
| 3,981,414 | * | 9/1976 | Gust et al. | 222/334 X |
| 4,120,424 | * | 10/1978 | Zygiel | 222/334 X |
| 4,181,242 | * | 1/1980 | Zygiel et al. | 222/129.2 X |
| 4,793,524 | * | 12/1988 | Starr | 222/309 |
| 4,863,066 | | 9/1989 | Uffenheimer et al. . | |
| 4,938,384 | * | 7/1990 | Pilolla et al. | 222/63 X |
| 4,998,850 | | 3/1991 | Crowell . | |
| 5,000,352 | * | 3/1991 | Cleland | 222/129.2 |
| 5,031,258 | | 7/1991 | Shaw . | |
| 5,152,429 | * | 10/1992 | Billings | 222/129.2 |
| 5,215,216 | | 6/1993 | Van Marcke . | |
| 5,344,047 | | 9/1994 | Chen . | |
| 5,507,413 | | 4/1996 | Chen . | |
| 5,540,362 | | 7/1996 | Azuma et al. . | |

* cited by examiner

*Primary Examiner*—Kenneth Bomberg
(74) *Attorney, Agent, or Firm*—Parsons & Goltry; Robert A. Parsons; Michael W. Goltry

(57) ABSTRACT

An automatic fluid dispenser including a pump mechanism actuated by a piston movable between a first position, and a second position in which a fluid is dispensed. A conduit is coupled to the pump mechanism and couplable to a pressurized fluid source. A valve is carried by the conduit and is movable between an open position in which a pressurized fluid from the pressurized fluid source moves the piston to the second position, and a closed position stopping the pressurized fluid.

3 Claims, 2 Drawing Sheets

FIG. 1
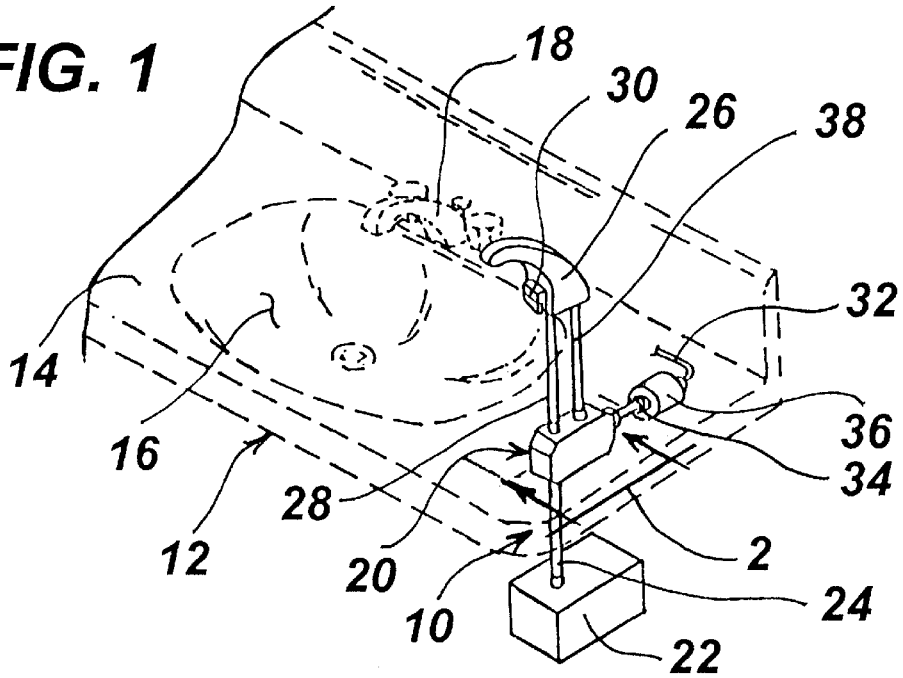
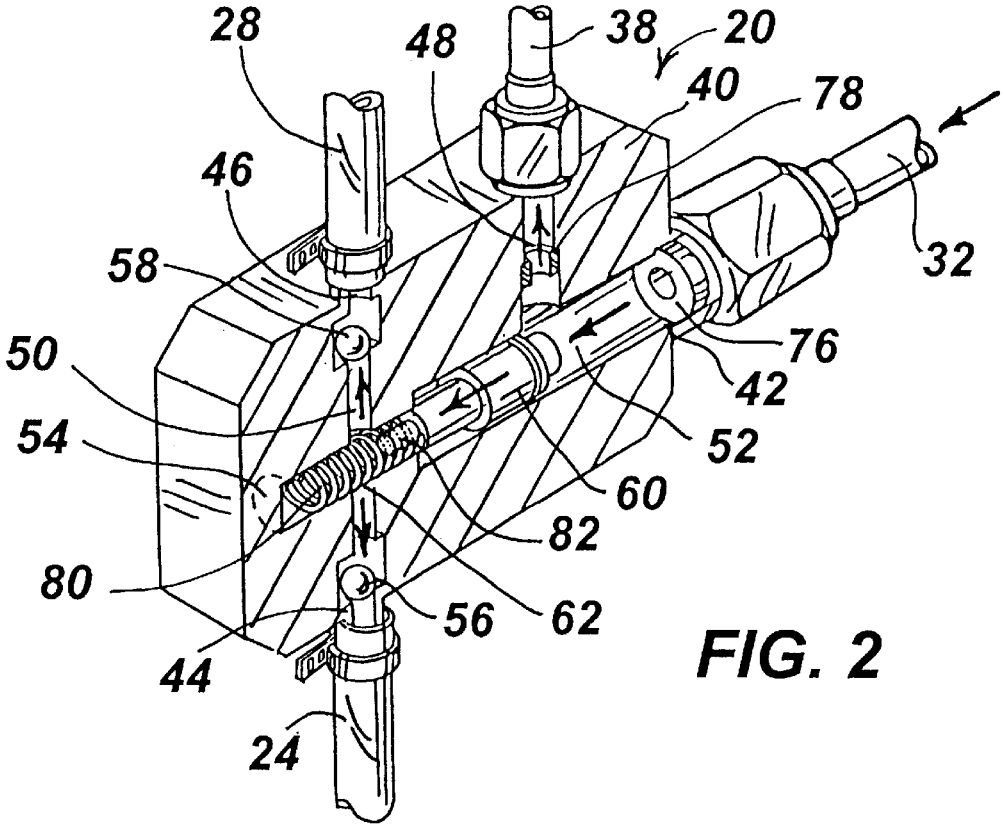
FIG. 2

FIG. 3
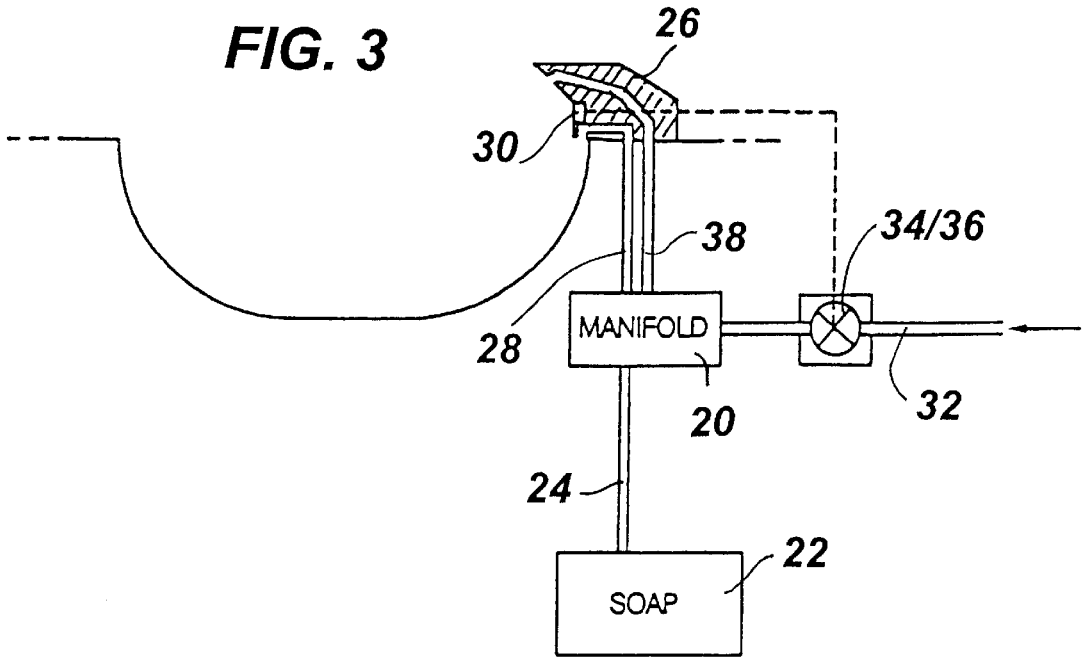
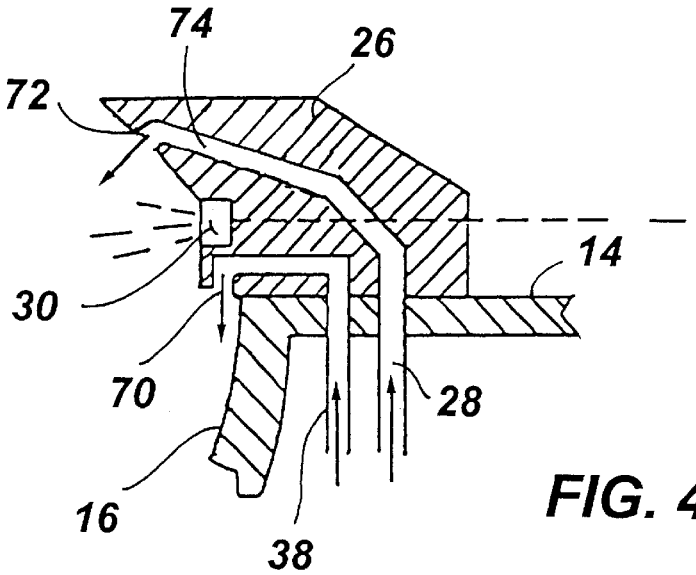
FIG. 4

AUTOMATED FLUID DISPENSER

FIELD OF THE INVENTION

This invention relates to devices for dispensing fluids.

More particularly, the present invention relates to automated dispensing devices.

In a further and more specific aspect, the instant invention concerns automatically dispensing liquid soap.

BACKGROUND OF THE INVENTION

Devices for dispensing fluids are well known and have been used to dispense liquid soaps, cleaning fluids, and condiments for many years. While capable of dispensing any fluid, the present invention is primarily concerned with dispensing liquid soap which will be the primary area of discussion.

Liquid soap is typically dispensed by the reciprocal translation of a plunger which pumps liquid soap from a source and ejects it from an aperture. These dispensers require manual manipulation of the plunger. Such manipulation serves as a vehicle for transmission of bacterial and viral contaminants to subsequent users.

There also exists pneumatically actuated and mechanically (motor/pump) actuated mechanisms for dispensing soap in response to a trigger signal. These devices require a relatively substantial amount of power, usually in the form of electrical power, to maintain the air or gas pressure necessary to operate the pneumatic dispenser or to operate a motor in a mechanical dispenser. Conventional electric power (120 volts AC) creates an electrical hazard in proximity to a wash basin, or the like, reducing the desirability of devices requiring large quantities of power.

It would be highly advantageous, therefore, to remedy the foregoing and other deficiencies inherent in the prior art.

Accordingly, it is an object of the present invention to provide a new and improved automatic fluid dispenser.

Another object of the invention is to provide an automatic soap dispenser which requires very little electrical power.

And another object of the invention is to provide an automatic soap dispenser which is self cleaning.

Still another object of the present invention is to provide an automatic soap dispenser which is adjustable to dispense a pre-determined quantity.

SUMMARY OF THE INVENTION

Briefly, to achieve the desired objects of the instant invention in accordance with a preferred embodiment thereof, provided is an automatic fluid dispenser including a pump mechanism actuated by a piston movable between a first position, and a second position in which a fluid is dispensed. A conduit is coupled to the pump mechanism and coupiable to a pressurized fluid source. A valve is carried by the conduit and is movable between an open position in which a pressurized fluid from the pressurized fluid source moves the piston to the second position, and a closed position stopping the pressurized fluid.

In a more specific aspect of the present invention, provided is an automatic fluid dispenser including a liquid soap reservoir, a soap dispensing fixture and a pump mechanism. The pump mechanism includes a housing defining a pump chamber having an inlet coupled to the liquid soap reservoir and an outlet coupled to the soap dispensing fixture. A first check valve is mounted in the inlet of the pump chamber for allowing liquid soap flow only into the pump chamber from the reservoir, and a second check valve is mounted in the outlet for allowing liquid soap flow only out of the pump chamber to the soap dispensing fixture. A piston is positioned within a bore in the housing for reciprocating motion between a first position in which the pump chamber has a volume and a second position in which the volume of the pump chamber is reduced. The pump mechanism further includes a biasing element biasing the piston into the first position. A conduit is coupled to the bore and coupled to a pressurized water source. The conduit directs pressurized water from the pressurized water source onto the piston. A valve is carried by the conduit and movable between an open position in which pressurized water from the pressurized water source moves the piston to the second position, and a closed position stopping the pressurized water. A water bleed is coupled to the bore between the piston and the valve. A sensor positioned proximate the fixture actuates a solenoid to move the valve to the open position. The valve is normally biased to the closed position.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 1 is a perspective view of an automatic soap dispenser according to the present invention as it would appear installed on a sink;

FIG. 2 is a sectional perspective view of the pump mechanism taken along line 2—2 of FIG. 1;

FIG. 3 is a side schematic view of the automatic soap dispenser according to the present invention; and FIG. 4 is a sectional side view of the dispensing fixture of the present invention.

DETAILED DESCRIPTION OF THE PREFERRED EMBODIMENT

Turning now to the drawings in which like reference characters indicate corresponding elements throughout the several views, attention is first directed to FIGS. 1 and 3 which illustrates an automatic soap dispenser generally designated 10, carried by a sink assembly 12 displayed in phantom lines. Sink assembly 12 is of conventional design, and includes a counter top 14, a bowl 16 formed in counter top 14, and a faucet 18 positioned to overhang bowl 16.

Automatic soap dispenser 10 includes a pump assembly 20 coupled to a reservoir 22 by a conduit 24, and an outlet fixture 26 by a conduit 28. An actuating assembly controls the operation of pump assembly 20 by regulating a flow of pressurized water. Upon release of pressurized water to pump assembly 20 a quantity of soap is dispensed. The actuating assembly includes a sensor 30 mounted on or proximate fixture 26, a conduit 32 from a pressurized water source, and a valve 34 opened and closed by a solenoid 36 upon triggering of sensor 30. Additionally, a conduit 38 is coupled between pump mechanism 20 and an outlet of fixture 26. As will be described presently, conduit 38 allows the elimination of water employed to operate pump mechanism 20. In the preferred embodiment, all of the elements described are mounted below counter top 14 except fixture 26 positioned to dispense soap over bowl 16, and sensor 30 positioned on or proximate fixture 26.

Referring now to FIG. 2, pump assembly 20 includes a housing 40 having a water inlet 42, a soap inlet 44, a soap outlet 46 and a water outlet 48. A bore 50 extends between soap inlet 44 and soap outlet 46, intersecting a bore 52 extending from water inlet 42 and terminating at closed end 54. Check valves 56 and 58 are formed at soap inlet 44 and soap outlet 46, respectively, to prevent back flow of soap. It will be understood that check valves 56 and 58 can be positioned anywhere along conduits 24 and 28, respectively, Lo prevent backflow of material. A piston 60 is reciprocally movable within bore 52 between a forward stroke and a rearward stroke. A volume of a chamber 62, defined by bore 50 between check valves 56 and 58, and bore 52 at the intersection thereof, is reduced and increased by the movement of piston 60 between the forward stroke and the rearward stroke, respectively. As the volume is reduced, soap is expelled through check valve 58 into conduit 28. During the rearward stroke the volume is increase to a normal volume, creating a vacuum which draws soap past check valve 56 into chamber 62 from conduit 24. The quantity of soap dispensed is dependent upon the size of chamber 62 and the length of the stroke of piston.

The forward stroke of piston 60 is produced by the release of pressurized water from conduit 32 by valve 34. Valve 34 is biased closed and is opened for a brief period by solenoid 36 and automatically closed. The surge of pressurized water drives piston 60 in the forward stroke. The water is then bled away through water outlet 48 and conduit 38. The bled off water can be disposed of in many different manners. Conduit 36 can direct the water directly to a drain pipe, mix the water with the dispensed soap, etc. In this embodiment, as can be seen in FIG. 4, the water is directed to an outlet 70 of fixture 26, which disposes of the water onto the side of bowl 16. This aids in washing any soap residue from bowl 16 after soap has been dispensed.

Still referring to FIG. 4, fixture 26 includes a dispense outlet 72 coupled to conduit 28 by a channel 74. In the preferred embodiment, channel 74 is inclined from conduit 28 to outlet 72. The incline prevents liquid soap from dripping into bowl 16. Once the soap is dispensed any residual soap is prevented from exiting outlet 72 by the incline of channel 74.

Referring back to FIG. 2, the force of the water acting upon piston 60 can be adjusted by positioning bushings 76 and 78 within water inlet 42 and/or water outlet 48. The amount of constriction produced by bushings 76 and 78 will increase the force of the water from conduit 32 and reduce the speed with which the water is bled away. By adjusting these factors, less water may be needed.

The rearward stroke is achieved by a biasing element 80 which forces piston 60 into the rearward stroke. The rearward movement of piston 60 displaces the water which moved piston 60 in the forward stroke, through water outlet 48. In this embodiment, biasing element 80 is a compression spring carried within bore 52 between end 54 and piston 60. Piston 60 includes an adjustable stop 82 for varying a distance between the first position and the second position whereby the reduction of the volume of the chamber is adjustable. Stop 82 is preferably threadably engaged to the end of piston 60. By adjusting stop 82 outward, the stroke of piston 60 is reduced thereby reducing the amount of soap dispensed. Conversely, by adjusting stop 82 inward, the stroke of piston 60 is increased thereby increasing the amount of soap dispensed.

By employing a pressurized water source to power the dispensing of soap, large amounts of hazardous electrical power are not required. A small amount of power needs to be supplied to sensor 30 and solenoid 36, but battery power is sufficient for this requirement.

Various changes and modifications to the embodiments herein chosen for purposes of illustration will readily occur to those skilled in the art. For example, while the preferred embodiment of the present invention is driven by pressurized water to dispense liquid soap, one skilled in the art will understand that substantially any fluid can be dispensed and the device can be driven by other pressurized sources. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An automatic fluid dispenser comprising:

a liquid soap reservoir;

a soap dispensing fixture;

a pump mechanism including a housing defining a pump chamber having an inlet coupled to the liquid soap reservoir and an outlet coupled to the soap dispensing fixture, a first check valve mounted in the inlet of the pump chamber for allowing liquid soap flow only into the pump chamber from the reservoir, and a second check valve mounted in the outlet for allowing liquid soap flow only out of the pump chamber to the soap dispensing fixture, a piston positioned within a bore in the housing for reciprocating motion between a first position in which the pump chamber has a volume and a second position in which the volume of the pump chamber is reduced, the pump mechanism including a biasing element biasing the piston into the first position;

a conduit coupled to the bore and coupled to a pressurized water source, the conduit directing pressurized water from the pressurized water source onto the piston;

a valve carried by the conduit and movable between an open position in which pressurized water from the pressurized water source moves the piston to the second position, and a closed position stopping the pressurized water;

a water bleed coupled to the bore between the piston and the valve; and a sensor for actuating a solenoid to move the valve to the open position, the valve being normally biased to the closed position, the sensor being positioned proximate the fixture.

2. An automatic fluid dispenser as claimed in claim 1 wherein the biasing element includes a compression spring carried between the piston and an end of the bore.

3. An automatic fluid dispenser as claimed in claim 1 wherein the piston includes an adjustable stop for varying a distance between the first position and the second position whereby the reduction of the volume of the chamber is adjustable.

* * * * *